US005611469A

United States Patent [19]

Eiley et al.

[11] Patent Number: 5,611,469

[45] Date of Patent: Mar. 18, 1997

[54] HANGER WITH IDENTIFICATION CLIP

[75] Inventors: Stanley Eiley, Mount Royal; Marc Tremblay, Pierrefonds, both of Canada

[73] Assignee: E.R.A. Display Co. Ltd., St. Laurent, Canada

[21] Appl. No.: 429,651

[22] Filed: Apr. 27, 1995

[51] Int. Cl.[6] ..... A47G 25/14

[52] U.S. Cl. ..... 223/85; 40/322

[58] Field of Search ..... 223/85, 92; D6/315; 40/322

[56] References Cited

U.S. PATENT DOCUMENTS 5,199,608 4/1993 Zuckerman .
5,238,159 8/1993 Zuckerman .
5,407,109 4/1995 Zuckerman ..... 223/85
5,441,182 8/1995 Sullivan ..... 40/322
5,449,099 9/1995 Blanchard ..... 40/322
5,469,995 11/1995 Bredeweg et al. ..... 40/322

*Primary Examiner*—Bibhu Mohanty
*Attorney, Agent, or Firm*—Marvin S. Towsend

[57] ABSTRACT

An identification clip for a garment hanger, wherein the garment hanger has a clip holder with a retaining pin and a flange spaced apart and parallel thereto forming a gap therebetween. The clip has side walls and a bight portion and the ends of the U forming a nip adapted to fit in the gap when the identification clip is on the retaining portion of the hanger so as to avoid easy removal of the clip from the hanger.

3 Claims, 3 Drawing Sheets

HANGER WITH IDENTIFICATION CLIP

BACKGROUND OF THE INVENTION

1. Field of the Invention

This invention relates to garment hangers having an identification clip, but more particularly to a garment hanger with an identification clip which cannot be readily removed manually.

2. Description of the Prior Art

Garment hangers which make use of information or identification tabs allow stores or garment manufacturers to display information about the garment to prospective customers. A garment hanger having a display or identification tab can provide size or brand of clothing on the hanger. It is important that these identification tabs be interchangeable and, therefore, easily removable or insertable on the hangers.

For example, stores will often retain the garment hanger upon the sale of a garment and reuse them with a new collection of garments. Accordingly, new garments placed on the garment hangers have ,to be selected according to a matching identification tab, or the identification tab is removed by a salesclerk and replaced with one indicating the proper size or identification of the garment.

Although these garment hangers with identification tabs are not new, once available to the purchaser, the removable tab can pose a danger to small children who may swallow it.

Changes have recently been made to these tabs to prevent the removal of the tab once it has been inserted on the garment hanger. The problem, associated with removal of the information tabs from the garment hanger, is not completely resolved since such tabs can still be removed with little effort.

For example, U.S. Pat. Nos. 5,199,608, 1993, Zuckerman, and 5,238,159, 1993, Zuckerman, teach the use of identification tabs which, once installed or inserted on the tab holder, are more difficult to remove (depending on the thickness of the material). Although the patents mention that a tool can be used to remove the tabs, their inherent designs would make the removal, even with a tool, very difficult without breakage. In addition, multiple insertions and removals of the tabs from the garment hanger are likely to cause the weakening of the plastic such that the tab eventually breaks down after multiple usage.

It is, therefore, desirable to provide a garment hanger having an identification clip which can be removed manually with difficulty and thus is childproof, but which can be removed with a tool repeatedly without weakening the structure of the tab or the tab holder itself on the garment hanger.

SUMMARY OF THE INVENTION

Accordingly, it is an object of the present invention to provide a garment hanger adapted to receive an identification clip which cannot be removed manually.

Yet another object of the present invention is to provide a garment hanger adapted to receive an identification clip which can be removed repeatedly using a proper tool without structural damage to the identification clip.

In accordance with an embodiment of the present invention, there is provided a garment hanger having a body and a hook, adapted to receive an identification clip, the hanger comprising a clip holder having a retaining pin and a flange fixedly connected between end members formed between the hook and the body, the retaining pin being disposed axially adjacent and spaced apart of the flange to form a gap therebetween; and a clip having means to display garment information, the clip being adapted to mate with the clip holder between the end members, the clip having parallel side walls forming the display means at one end and a clip opening at the other end, the clip opening being formed by the parallel side walls tapering first inwardly to meet at an apex and then outwardly thereof to form the opening, the apex of each parallel side forming a retaining nip adapted to fit in the gap between the retaining pin and the flange, such that when the clip is inserted on the clip holder, the clip opening can rest adjacent the flange to prevent removal of the clip from the clip holder.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figures 1, 2A:
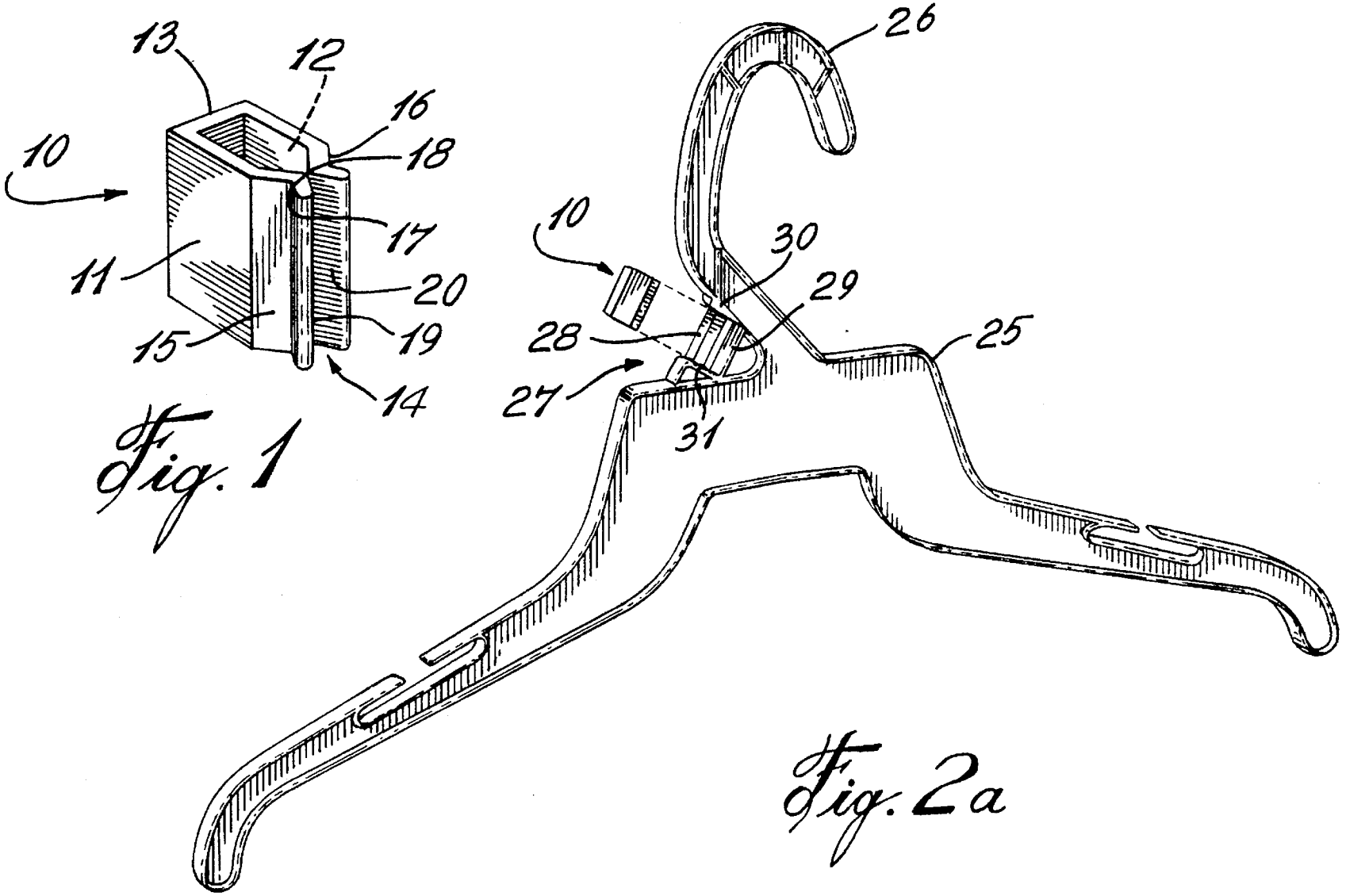
FIG. 1 is a perspective view of the identification clip of the present invention.
FIG. 2*a* is a perspective view of the garment hanger and clip holder design for use with the clip of FIG. 1.

Referring now to FIG. 1, we have shown generally at reference numeral 10, a perspective view of an identification clip according to an embodiment of the present invention. The identification clip 10 can be made of molded plastic which is resilient enough to prevent breakage when inserted in the clip holder, or can similarly be made of metal.

Identification clip 10 is provided with parallel side walls 11 and 12 with a bight 13 to form a display area to enable the garment manufacturer or. store reseller to indicate the size or colour or other identification of the garment placed on the hanger.

Parallel side walls 11 and 12 form the clip opening 14 at the other end. The clip opening 14 is formed by the parallel side walls 11 and 12 having converging wall portions 15 and 16 to meet at an apex 17 and 18 and then diverging wall portions 19 and 20. The apexes 17 and 18 of parallel side walls 11 and 12 form a retaining nip which, when used with the clip holder, makes the removal of the identification clip difficult.

Figure 2B:
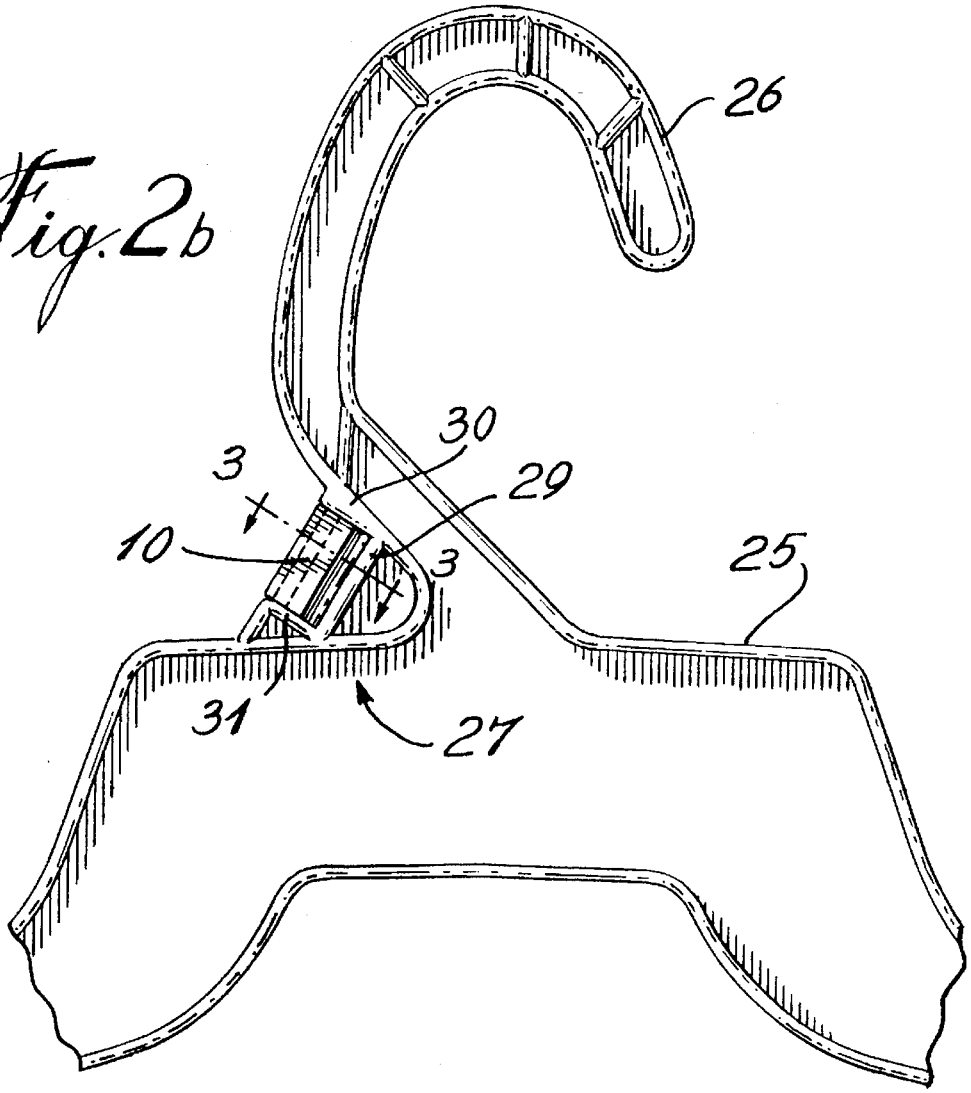
FIG. 2*b* is a fragmentary, enlarged, side view of the garment hanger showing the identification clip inserted in the clip holder.
Figure 2C:
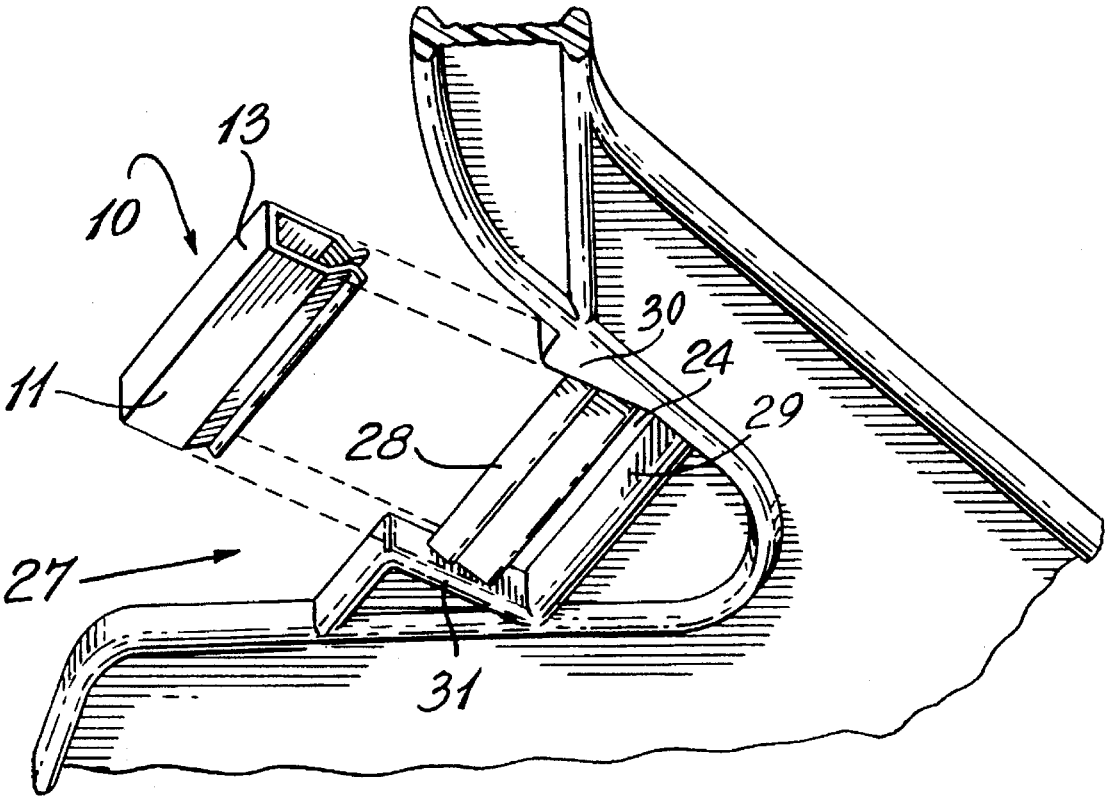
FIG. 2*c* is an enlarged, fragmentary, exploded, perspective view of the identification clip and clip holder.

Referring now to FIGS. 2*a*, 2*b*, and 2*c*, there is shown a typical garment hanger, having a body 25 and a hook 26. The garment hanger can be made of a one-piece unitary molded plastic. The identification clip holder shown generally at reference numeral 27 is comprised of a retaining pin 28 and a flange 29, both disposed and fixedly connected between end pieces 30 and 31 which are formed between the body 25 and the hook 26 of the garment hanger. A gap 24 is defined between the pin 28 and flange 29. The identification clip 10 is adapted to fit within close tolerances between end members 30 and 31, as is shown in FIG. 2*b*.

In FIG. 2*b*, the identification clip 10 is shown fully inserted on the clip holder 27. As will be shown more clearly further below, the clip opening 14 is adapted to be located in the gap 24 adjacent flange 29 when the identification clip is fully inserted onto clip holder 27. Thus, in this arrangement, the ends of wall portions 19 and 20 of the identification clip 10 are directly adjacent end members 30 and 31 and abut against the flange 29, closing the gap 24, whereas the clip opening 14 is hidden within the gap 24. Thus, this arrangement prevents the manual removal of the identification clip from the garment hanger.

Figure 3A:
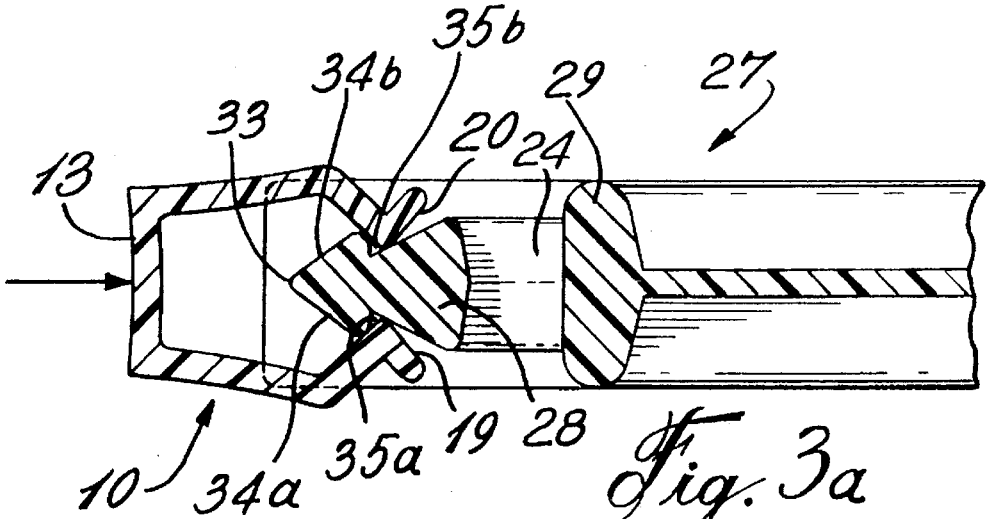
FIG. 3*a* is a sectional view, taken along line 3—3 of FIG. 2*b*, and showing the identification clip partially inserted on the clip holder.

In FIG. 3*a*, the mating of the identification clip 10 as it is inserted onto clip holder 27 is illustrated. Retaining pin 28 is provided with a pointed nose 33 and sides 34*a* and 34*b* which are divergent to facilitate the insertion of the identification clip 10 on the clip holder 27. In particular, side wall portions 19 and 20 of identification clip 10 are spread open by divergent sides 34*a* and 34*b* as they are pushed onto retaining pin 28. Retaining pin 28 is provided with a first set of grooves 35*a* and 35*b* to temporarily retain the identification clip 10 on the clip holder 27 until it is fully inserted onto the holder. If the identification clip does not correspond to the garment placed on the garment hanger, it can easily be removed by simply pulling on the identification clip.

Figure 3B:
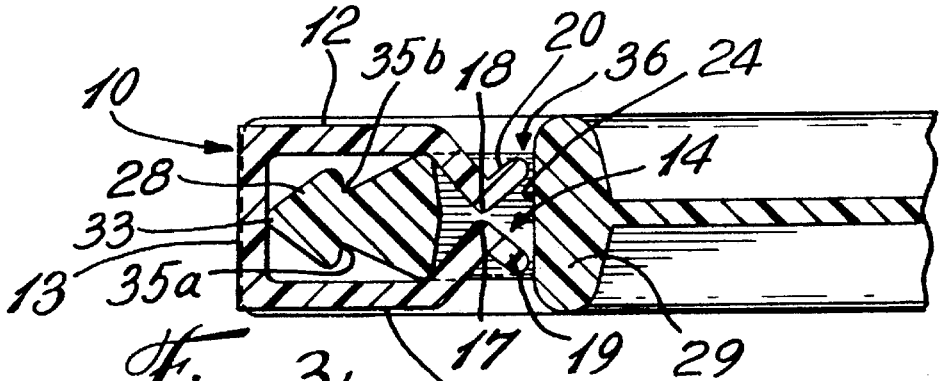
FIG. 3*b* is a sectional view, taken along line 3—3 of FIG. 2*b*, showing the identification clip fully inserted.

In FIG. 3*b*, the sectional view of the clip holder 27 is shown with the identification clip 10 fully inserted in the holder. As can be seen, once clip 10 is fully inserted, the tapered side walls 19 and 20 return to their rest position grasping the retaining pin 28. In addition, the opening 14 of identification clip 10 is confined within the gap 24 thereby making it difficult to manually remove the identification clip 10. A small gap 36 remains between flange 29 and the ends of side wall portions 19 and 20 of retaining clip 10 to enable the insertion of a tool for removal of the identification clip 10. Once inserted, the nose 33 of retaining pin 28 abuts the inner side of the bight 13 of identification clip 10. As can be seen in FIG. 3, the apexes 17 and 18 of side walls 11 and 12 form a retaining nip adapted to fit in the gap 24 created between retaining pin 28 and flange 29.

We claim:

1. A garment hanger having a body and a hook adapted to receive an identification ciip, said hanger comprising:

a clip holder having a retaining pin and a flange fixedly connected between end members formed between said hook and said body, said retaining pin being disposed parallel and spaced apart of the flange to form a gap therebetween, said retaining pin further comprises a pair of sides which diverge from a pointed nose to a ridge located on each side of said retaining pin to define the gap with the flange; and a clip having means to display garment information, said clip being adapted to mate with said clip holder between said end members, said clip having side walls and a bight portion at one end forming said display means and a clip opening at the other end, said clip opening being formed by said side walls converging inwardly, each to define an apex, and diverging end walls extending from the apex to form a mouth, the apex of each side wall forming a retaining nip adapted to fit in said gap, between the ridges and said flange, such that when said clip is inserted on said clip holder, said clip opening and divergent end walls are adjacent said flange and within the confines of the gap to prevent removal of said clip from said clip holder.

2. A garment hanger as defined in claim 1, wherein a space remains between said clip end walls and said flange when said clip is fully inserted on said clip holder.

3. The garment hanger and display clip combination as defined in claim 1 wherein said retaining pin has a first pair of retaining walls terminating at a first set of grooves to enable the clip to be temporarily retained thereon and a second pair of divergent walls between the first set of grooves and the ridges forming the gap.

* * * * *